US005835829A

United States Patent [19]

Genovese et al.

[11] Patent Number: 5,835,829

[45] Date of Patent: Nov. 10, 1998

[54] SINGLE-ENDED SYMMETRIC RESISTIVE RING DESIGN FOR SED ROLLS

[75] Inventors: Frank C. Genovese, Fairport; Mark S. Amico, Rochester, both of N.Y.

[73] Assignee: Xerox Corporation, Stamford, Conn.

[21] Appl. No.: 854,789

[22] Filed: May 12, 1997

[51] Int. Cl.[6] ..... G03G 15/08

[52] U.S. Cl. ..... 399/285; 399/279; 399/291

[58] Field of Search ..... 399/279, 285, 399/286, 290, 291

[56] References Cited

U.S. PATENT DOCUMENTS

| | | | |
|---|---|---|---|
| 5,172,170 | 12/1992 | Hays et al. . | |
| 5,172,259 | 12/1992 | Cloonan et al. | 359/139 |
| 5,289,240 | 2/1994 | Wayman . | |
| 5,413,807 | 5/1995 | Duggan et al. | 427/58 |
| 5,448,342 | 9/1995 | Hays et al. | 399/285 |
| 5,473,414 | 12/1995 | Thompson | 399/354 |
| 5,517,287 | 5/1996 | Rodriguez et al. | 399/285 |
| 5,592,271 | 1/1997 | Parker et al. | 399/285 |
| 5,594,534 | 1/1997 | Genovese | 399/285 |
| 5,594,543 | 1/1997 | de Groot et al. | 356/5.09 |
| 5,600,418 | 2/1997 | Hart et al. | 399/285 |
| 5,701,564 | 12/1997 | Parker | 399/285 |
| 5,729,807 | 3/1998 | Parker | 399/285 |

*Primary Examiner*—Matthew S. Smith
*Attorney, Agent, or Firm*—Lloyd F. Bean, II

[57] ABSTRACT

A donor roll for transporting marking particles to an electrostatic latent image recorded on a surface is provided. The donor roll is adaptable for use with an electric field to assist in transporting the marking particles from the donor roll to a development zone adjacent the surface. The donor roll includes a rotatably mounted body and a first electrode member mounted on the body. The donor roll further includes a second electrode member mounted on the body and spaced from the first electrode member and a resistive member electrically interconnecting the first electrode member and the second electrode member so that when an activation potential for creating an electric field is applied to the first electrode member a portion of the potential will be transferred to the second electrode member creating an attenuated field.

4 Claims, 8 Drawing Sheets

| RESISTOR RATIO | MAX FIELD GRADIENT V/MIL |
|---|---|
| r=.05 | 11.5 |
| r=.08 | 14.4 |
| r=.1 | 15.8 |
| r=.15 | 18.8 |
| r=.2 | 21.1 |
| r=.4 | 27.2 |
| r=.6 | 31.2 |
| r=1.0 | 36.3 |

SINGLE-ENDED SYMMETRIC RESISTIVE RING DESIGN FOR SED ROLLS

BACKGROUND OF THE PRESENT INVENTION

The present invention relates to a developer apparatus for electrophotographic printing. More specifically, the invention relates to a donor roll as part of a scavengeless development process.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically charged powder known as "toner." Toner is held on the image areas by the electrostatic interaction between the toner charge and the charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is removed from the surface. The process is useful for light lens copying from an original document, or printing electronically generated or stored originals, such as with a raster output scanner (ROS), where a charged surface may be imagewise discharged in a variety of ways.

In U.S. Pat. No. 5,172,170 to Hays et al., there is disclosed an apparatus for developing a latent image recorded on a surface, including a housing defining a chamber storing at least a supply of toner therein, a moving donor member spaced from the surface and adapted to transport toner from the chamber of said housing to a development zone adjacent the surface, and an electrode member integral with the donor member and adapted to move therewith. The electrode member is electrically energized with high voltage AC which creates strong alternating electric fields at the donor surface. These fields detach toner from said donor member and form a cloud of charged toner particles in the space between the electrode member and the photoreceptor surface thereby providing a supply of charged toner for developing the latent image. Activation of electrodes in the development nip is typically accomplished by means of a conductive brush which is placed in a stationary position in contact with electrode commutation pads on the periphery of the donor member. The conductive brush is driven by a DC biased AC electrical power source. The brush is typically a conductive fiber brush made of pultruded fibers, or a solid graphite brush positioned so that only a limited number of electrodes in the nip between the donor member and the developing photoreceptor surface are electrically activated as the donor member rotates. Since the width of the nip is very narrow, it is impractical to position the conductive brush itself directly in the nip, so the donor member is usually extended beyond the development zone to allow space for the brush and commutation pad assembly. U.S. Pat. No. 5,172,170 is herein incorporated by reference.

Electrical commutation using a stationary conductive brush positioned in contact with a plurality of individual electrode elements on the periphery of the donor member has several practical limitations. Many materials have been considered for fabricating the contacting brush including metallic and non-metallic formulations. Carbon fiber brushes and solid graphite brushes have been found to be the most robust. A resistance graded carbon fiber brush constructed with low resistance fibers in the center of the brush and higher resistance fibers on the leading and trailing ends of the brush has been shown to improve performance by providing gradual rather than discontinuous electrical connection and disconnection between the brush and individual electrodes. The rubbing contact of the brush on the commutation pads causes mechanical wear which limits the life of the brushes and the donor roll in the contacting area. It has also been observed that abrupt electrical commutation creates electrical noise and promotes electrical breakdown and electro-chemical erosion at the contacting points. The abrupt breaking of contacts at random phases of the High voltage AC activation waveform has also been found to leave random residual charges on the electrodes which indirectly causes irregular density bands in the developed image. Power dissipated in the brushes and commutation losses both generate heat which can soften and agglomerate stray toner particles in the commutation path, thereby reducing development reliability and adversely affecting copy quality. Also, when a carbon fiber brush is used, the fibers wear away and can break off from the brush and provide short circuit paths to the high voltage supply. Furthermore, other forms of contamination, including paper and clothing fibers can become trapped by the brush causing premature failure. To reduce these modes of failure, complicated and expensive filtering systems may be required to remove the paper and clothing fiber as well as toner agglomerates and other contaminants from the toner supply. Electrical noise generated by commutation can also cause imaging and development artifacts which are detrimental to copy quality.

In U.S. Pat. No. 5,594,543, discloses a "symmetric resistive ring" commutation architecture employs two continuous resistive ribbon structures at opposite ends of the roll connected respectively to extensions of the even and odd elements of the array of interdigitated electrodes. The resulting distributed resistor network takes the place of the circular array of individual bare nickel commutation pads in the prior art that are contacted by a graded conductivity carbon brush that sequentially supplies an excitation voltage directly to the driven elements of the electrode array. In the symmetric resistive ring architecture, each individual electrode is supplied excitation voltage indirectly via a resistive ring driven by an AC supply, and is provided a current return path directly to an adjacent conductive ring though an individual resistor. In this arrangement, the excitation supplies for the even and odd electrodes are 180 degrees out of phase and are delivered to the respective resistive and conductive rings at each end of the roll by a separate commutation brush assembly.

In accordance to the present invention there is provided a donor roll for transporting marking particles to an electrostatic latent image recorded on a surface, said donor roll adaptable for use with an electric field to assist in transporting the marking particles from said donor roll to a development zone adjacent the surface, said donor roll comprising: a rotatably mounted body; a first electrode member mounted on said body; a second electrode member mounted on said body and spaced from said first electrode member; a first resistive member electrically interconnecting said first electrode member; a second resistive member electrically interconnecting said second electrode member; and wherein said first and second resistive member are mounted on a common end of said body; and when the electric field is applied to said first electrode member a portion of the field will be transferred to second electrode member.

There is also provided an apparatus for developing a latent image recorded on a surface, including: a housing defining a chamber storing at least a supply of toner therein; a moving donor roll spaced from the surface and adapted to transport toner from the chamber of the housing to a development zone adjacent the surface; sets of even and odd electrodes longitudinally disposed on the donor roll; and a commutator assembly contacting the sets of even and odd electrodes along a single portion of the circumference of the donor roll.

One object of the present invention is to provide an architecture in which a single brush assembly can be made to supply both the even and odd electrodes from the same end of the roll, thereby providing a compact high voltage distribution network.

A second object of the present invention is to reduce the number of brush assemblies required in a printing apparatus by designing the assemblies to supply pairs of adjacent rolls. This not only reduces the number of individual brush assemblies needed, but the cost of the extra connectors and associated high voltage wiring, as well as assembly costs.

IN THE DRAWINGS

The invention will be described in detail herein with reference to the following figures in which like reference numerals denote like elements and wherein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 2 printing machine will be shown hereinafter schematically and their operation described briefly with reference thereto.

Figure 2:
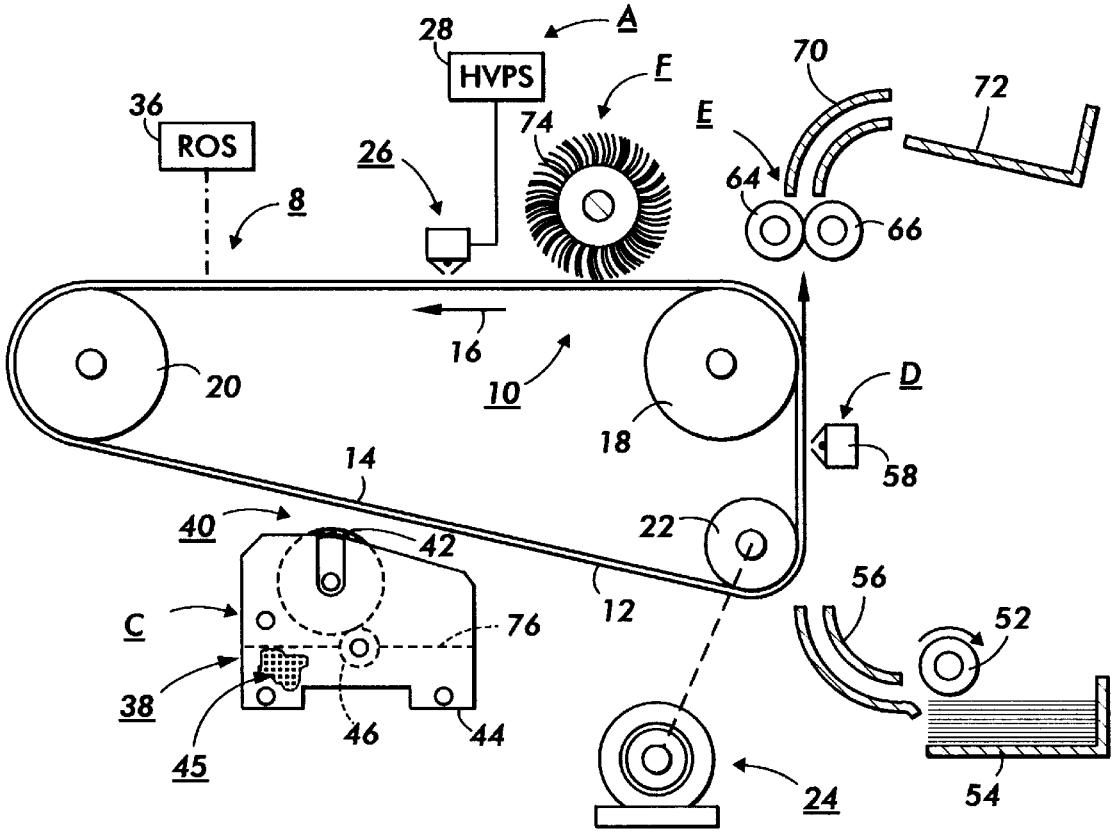
FIG. 2 is a schematic elevational view of printing machine incorporating the resistive network commutation segmented donor roll of FIG. 1.

Referring initially to FIG. 2, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably the surface 12 is made from a selenium alloy or a suitable photosensitive organic compound. The substrate 14 is preferably made from a polyester film such as Mylar® (a trademark of Dupont (UK) Ltd.) coated with a thin layer of a metal alloy which is electrically grounded. The belt is driven by means of motor 24 along a path defined by rollers 18, 20 and 22, the direction of movement being counter-clockwise as viewed in FIG. 2 and indicated by arrow 16. Initially a portion of the belt 10 passes through a charging station A where corona generator 26 charges surface 12 to a relatively high, substantially uniform, potential. A high voltage power source 28 supplies current to generator 26.

Subsequent to charging, photoconductive surface 12 is advanced through exposure station B where raster output scanner (ROS) 36 exposes the surface 12 in a raster pattern consisting of a series of closely spaced horizontal scan lines having a specified number of pixels per inch. The ROS includes a laser source controlled by a data source, a rotating polygon mirror, and optical elements associated therewith. The ROS exposes the charged photoconductive surface 12 point by point to generate the latent electrostatic image to be printed. It will be understood by those familiar with the art that alternative exposure systems for generating the latent electrostatic image, such as print bars based on liquid crystal light valves and light emitting diodes (LEDs), or a conventional light lens arrangement could be used in place of the ROS system.

After the electrostatic latent image has been recorded on photoconductive surface 12, belt 10 advances the latent image to development station C as shown in FIG. 2. At development station C, a development system 38 develops the latent image recorded on the photoconductive surface. Preferably, development system 38 includes one or multiple donor rolls or rollers 40 incorporating electrical conductors in the form of electrode wires or electrodes 42 in the gap between the donor roll 40 and photoconductive belt 10. Electrodes 42 are electrically activated with high voltage AC potentials to detach charged toner particles from the roll surface and form a toner powder cloud in the gap between the donor roll and photoconductive surface. The latent image attracts the charged toner particles from the toner powder cloud developing a visible toner powder image thereon. Donor roll 40 is mounted, at least partially, in the chamber of developer housing 44. The chamber in developer housing 44 stores a supply of two-component developer material 45 consisting of at least magnetic carrier granules having toner particles adhering triboelectrically thereto. A transport roll or roller 46 disposed wholly within the chamber of housing 44 conveys the developer material to the donor roll 40. The transport roll 46 is electrically biased relative to the donor roll 40 so that the toner particles are attracted from the transport roller to the donor roll.

Again referring to FIG. 2, after the electrostatic latent image has been developed, belt 10 advances the developed image to transfer station D, at which a copy sheet 54 is advanced by roll 52 past guides 56 into contact with the developed image on belt 10. Corona generator 58 deposits ions on the back surface of sheet 54 to attract the developed toner image from the surface of belt 10 to the surface of copy sheet 54. As belt 10 passes over roller 18, copy sheet 54 with the transferred toner image is stripped from the belt surface.

After transfer, the sheet is advanced by a conveyor (not shown) to fusing station E. Fusing station E includes a heated fuser roller 64 and a back-up roller 66. Copy sheet 54 passes between fuser roller 64 and back-up roller 66 with the toner powder image contacting the surface of fuser roller 64. In this way, the toner powder image is permanently affixed to the surface of copy sheet 54. After fusing, the copy sheet advances through chute 70 to catch tray 72 for subsequent removal from the printing machine by the operator.

After copy sheet 54 is stripped from the surface of belt 10, residual toner particles adhering to photoconductive surface 12 are removed at cleaning station F by a rotating fibrous brush 74 in contact with photoconductive surface 12. Subsequent to cleaning, a discharge lamp (not shown) floods photoconductive surface 12 with light to dissipate any residual electrostatic charge prior to recharging photoconductive surface 12 for the next successive imaging cycle.

It is believed that the foregoing description is sufficient for purposes of the present application to illustrate the general operation of an electrophotographic printing machine incorporating the development apparatus of the present invention.

Figure 3:
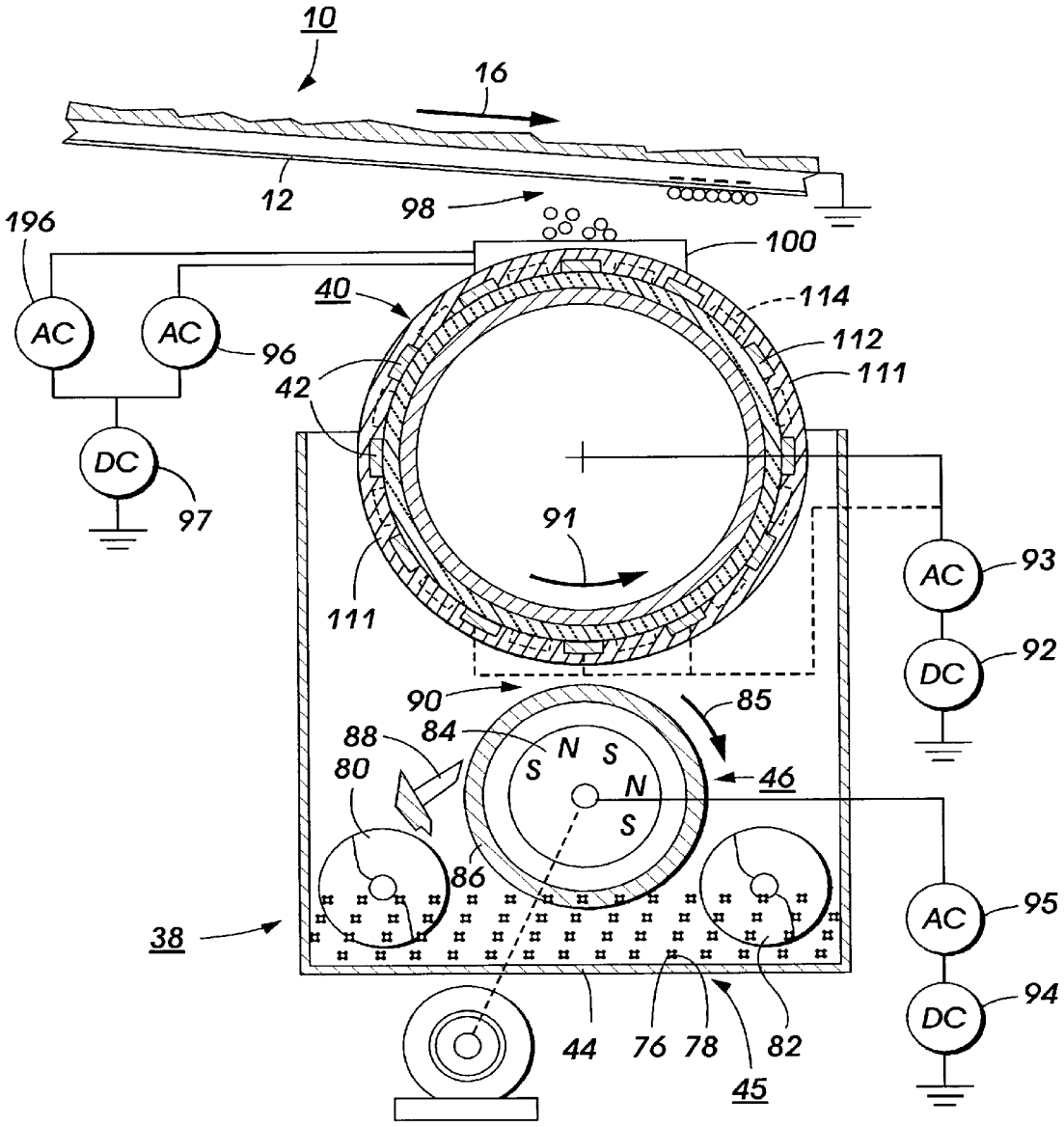
FIG. 3 is a schematic elevational view of development unit incorporating the resistive network commutation segmented donor roll of FIG. 1.

Referring now to FIG. 3, there is shown development system 38 in greater detail. Housing 44 defines the chamber for storing the supply of developer material 45 comprised of carrier granules 76 with triboelectrically adhered toner particles 78.

Augers 80 and 82 distribute developer material 45 uniformly along the length of transport roll 46 in the chamber of housing 44.

Transport roll 46 consists of a stationary multi-pole internal magnetic core 84 having a closely spaced sleeve 86 of non-magnetic material designed to be rotated about the body of magnetic core 84 in a direction indicated by arrow 85. Developer material in the form of magnetic carrier beads or granules 76 charged with toner particles 78 are attracted to the exterior of the sleeve 86 as it rotates through the stationary magnetic fields of magnetic core 84. A doctor blade 88 meters the quantity of developer adhering to sleeve 86 as it is transported to loading zone 90 in the nip between transport roll 46 and donor roll 40. This developer material adhering to the sleeve 86 contains magnetic carrier beads that form a filamentary structure commonly referred to as a magnetic brush.

The donor roll 40 includes electrodes 42 in the form of axial conductive elements spaced evenly around its peripheral circumferential surface. The electrodes are preferably positioned at or near the circumferential surface and may be applied by any suitable process such as photolithography, electroplating, laser ablation, silk screening, or direct writing. It should be appreciated that the electrodes may alternatively be delineated by axial grooves (not shown) formed in the periphery of the roll 40. The electrical conductors 42 are substantially spaced from one another and are typically formed on an insulating shell or non conductive layer applied over the core of donor roll 40 which may be electrically conductive.

Overcoating layer 111 covering those portions of roll 40 that interact with charged toner preferably consists of a material which has very low electrical conductivity, but is not totally insulating. The conductivity of this material must be low enough to behave as a blocking layer in order to suppress electrical breakdown between adjacent electrodes, as well as prevent short circuits or electrical discharges between the electrode elements and the conductive filaments of the magnetic brush in loading zone 90. However, those familiar with the powder development art will understand that this material must be sufficiently conductive to provide a well defined average surface potential in order to define the DC development zone fields in the gap between the donor roll 40 and photoconductive belt 10 in spite of any charge exchange that may take place at the donor roll surface.

Transport roll 46 is biased at a specific voltage with respect to system ground by a DC voltage source 94, with optional voltage source 95 providing an AC voltage component to the transport roll 46.

By controlling the output potentials of DC voltage sources 92 and 94, the DC electrical field strength applied in loading zone 90 between the magnetic brush filaments and the donor roll surface is defined. When the electric field between these members is of the correct polarity and of sufficient magnitude, toner particles 78 migrate from the magnetic brush filament tips and form a self-leveling layer of toner particles on the surface of donor roll 40. This development mechanism is confined to the area denoted as the loading zone 90.

By controlling the amplitude, frequencies, and phases of the AC voltage sources 93 and 95, the AC electrical field applied between the donor roll surface and the magnetic brush filaments on rotating sleeve 86 of magnetic roll 46 can be optimized. The application of the AC electrical field across the magnetic brush is known to improve uniformity and enhance the rate at which toner deposits on the surface of the donor roll 40 in the loading zone. It is believed that the application of an AC electrical field component in loading zone 90 helps break the cohesive and electrostatic bonds between toner particles and carrier beads, statistically softening the threshold for migration of the toner particles to the donor roll surface under the action of the DC electrical field.

In the loading zone, although an AC potential difference can be applied between the interdigitated electrodes to enhance loading behavior, for simplicity it is preferred that conductive electrodes 42 comprising even electrodes 112 and odd electrodes 114 be operated at the same potential. In this case both sets of electrodes would be driven by voltage sources 92 and 93 while passing through the loading zone as indicated by the broken line in FIG. 2.

While the development system 38 as shown in FIG. 3 utilizes both DC voltage source 92 and AC voltage source 93 to supply the electrodes 112 and 114, as well as transport roller DC voltage source 94 and AC voltage source 95, the invention may be practiced with merely DC voltage source 92 supplying electrodes 112 and 114 on donor roll 40.

It has been found that an AC voltage amplitude of about 200 V rms applied across the magnetic brush between the surface of the donor roll 40 and the sleeve 86 is sufficient to maximize the loading/reloading rate of donor roll 40. That is, the delivery rate of toner particles from the magnetic brush to the donor roll surface is optimized. In any specific example, the optimum voltage amplitude depends on the reloading zone geometry and can be adjusted empirically. In theory, any value can be applied up to the point at which discharge occurs within the magnetic brush. For typical developer materials, donor roll to transport roll spacings, and material packing fractions, this maximum value is on the order of 400 V rms at an AC frequency of about 2 kHz. It has been observed that if the frequency is too low, e.g. less than 200 Hz, image density banding visible to the eye can be seen on the copies due to the periodic variation of toner delivered by the donor roll. If the frequency is relatively high, e.g. more than 15 kHz, the toner migration rate is enhanced, but the AC high voltage supplies must be designed to deliver much higher capacitive load currents, and consequently not only cost more to manufacture, but the higher power output capacity can cause more inadvertent damage in cases of momentary electrical discharges.

Donor roll 40 rotates in the direction of arrow 91. The relative voltage between the electrodes 112 and 114, and the sleeve 86 of magnetic roll 46 is selected to provide efficient loading of toner from the magnetic brush onto the surface of the donor roll 40. DC electrode voltage source 97 and AC sources 96 and 196 respectively, are arranged to electrically energize electrodes 112 and 114 in sequence as donor roll 40 rotates in the direction of arrow 91, and successive pairs of electrodes 112 and 114 advance into development nip 98 between the donor roll 40 and the photoreceptor belt 10.

As shown in FIG. 3, according to the present invention, resistive network commutator 100 connected to electrode voltage sources 97, 96, and 196 distributes DC biased AC voltage waveforms to electrodes 112 as they advance into development nip 98 due to the rotation of donor roll 40 in the direction of arrow 91, and simultaneously distribute a voltage waveform with the same DC bias, and equal AC amplitude but opposite phase to electrodes 114 as they advance into development nip 98 due to the rotation of donor roll 40

In this way, a common bias voltage is supplied to both sets of electrodes 112 and 114, and a large AC voltage difference is applied symmetrically between adjacent even electrodes 112 and odd electrodes 114 thereby providing strong oscillating electric fields between adjacent electrodes in a narrow zone at the surface of donor roll 40 that detach toner from the donor roll surface and form a localized toner powder cloud in development nip 98.

The construction and geometry of a segmented donor roll is described in detail in U.S. Pat. No. 5,172,259 to Hays et al., U.S. Pat. No. 5,289,240 to Wayman, and U.S. Pat. No. 5,413,807 to Duggan the relative portions thereof incorporated by reference herein.

The applicants have determined that the required AC activation potential for the formation of a well defined toner cloud on donor roll 40, with longitudinal interdigitated even electrodes 112 and odd electrodes 114 both approximately 0.004 inches wide and spaced approximately 0.005 inches apart around the periphery of the donor roll 40, is approximately 1000 to 1,300 volts rms at 3 kHz.

Figure 1:
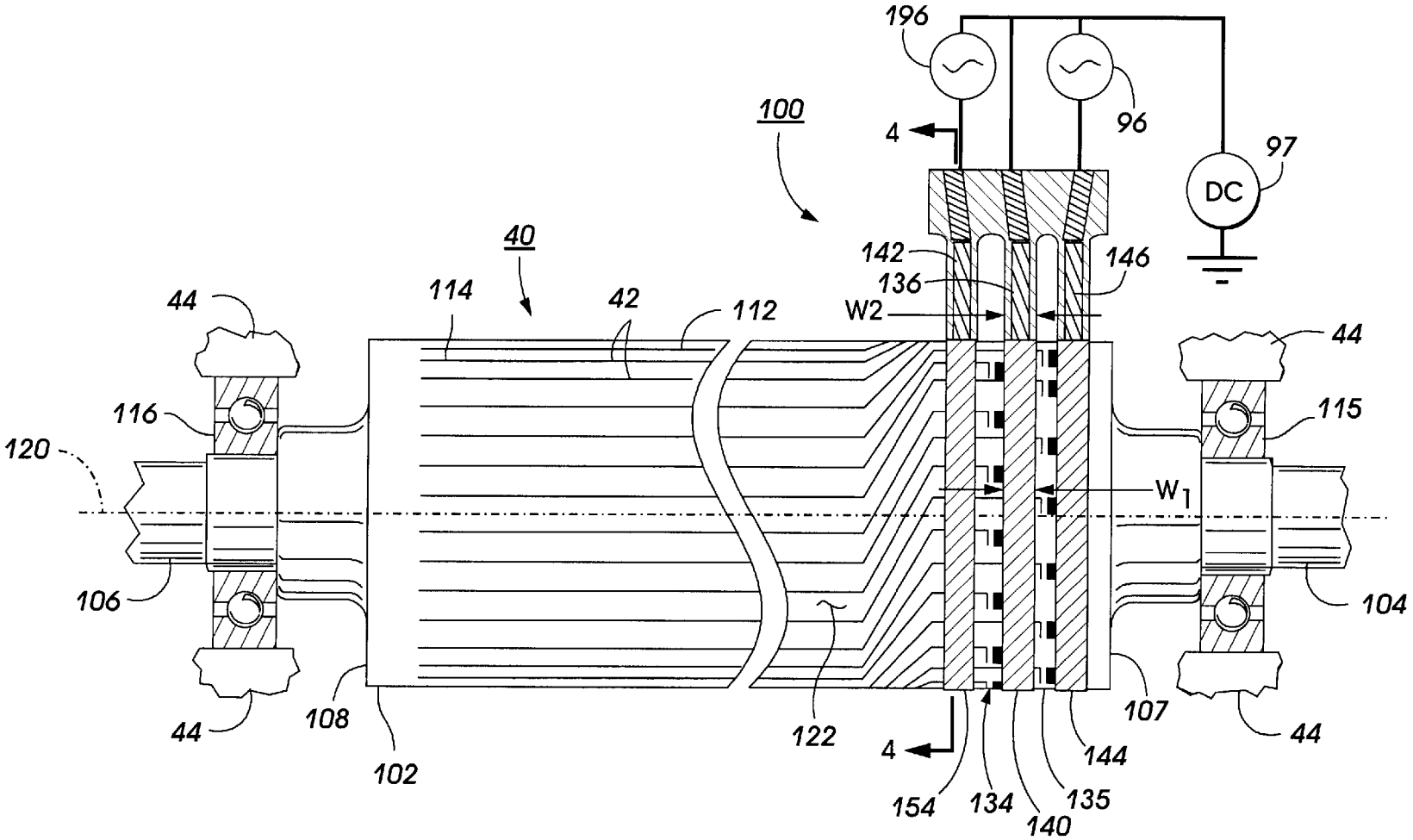
FIG. 1 is an elevational view of a first embodiment of a resistive network commutation segmented donor roll of the present invention.

According to the present invention and referring to FIG. 1, the resistive network commutator 100 on donor roll 40 is shown in greater detail. The donor roll 40 is made of any suitable durable material, for example, a ceramic rod or tube, or a polyamide sleeve bonded over a rigid metal shaft. The donor roll 40 includes a body 102 from which first journal 104 and second journal 106 extend from first end 107 and second end 108, respectively, of the body 102 of donor roll 40. The donor roll 40 may be supported by any suitable method, for example, as shown in FIG. 1, by first and second bearings 115 and 116 mounted in bearing pockets in developer housing 44 and supporting the first and second journals 104 and 106, respectively. Periphery 122 of donor roll 40 is patterned with an array 42 of narrowly-spaced conductive electrode elements parallel to axis 120 of donor roll 40. Electrode array 42 comprises interdigitated electrodes 112 and 114, which are electrically activated in timed sequence via distribution through resistive network commutator 100 from fixed electrical contact brush 146 that supplies current to resistive ring 144 from AC power sources 96, brush 142 that supplies current to resistive ring 154 from AC source 196, and brush 136 that provides a DC return path from conductive common ring 140 to DC source 97

Within electrode array 42, electrodes 112 and electrodes 114 are arranged in an interdigitated pattern, that is, each electrode 114 is positioned midway between adjacent electrodes 112 and vice versa over the central clouding portion of donor roll 40. Electrodes 112 are activated by the currents distributed through the resistive network comprising resistive ring 144 and resistive members 135 of resistive network commutator 100. Likewise, electrodes 114 are activated by the currents distributed through the resistive network comprising resistive ring 154 and resistive members 134. Resistive members 134 and 135 may be discrete components, or a distributed design fabricated according to thin film or thick film methods known to those skilled in the hybrid electronic circuit art using any suitable material having the proper geometry and sheet resistivity preferably in the range of a few kOhms per square to a few megOhms per square.

Figure 4:
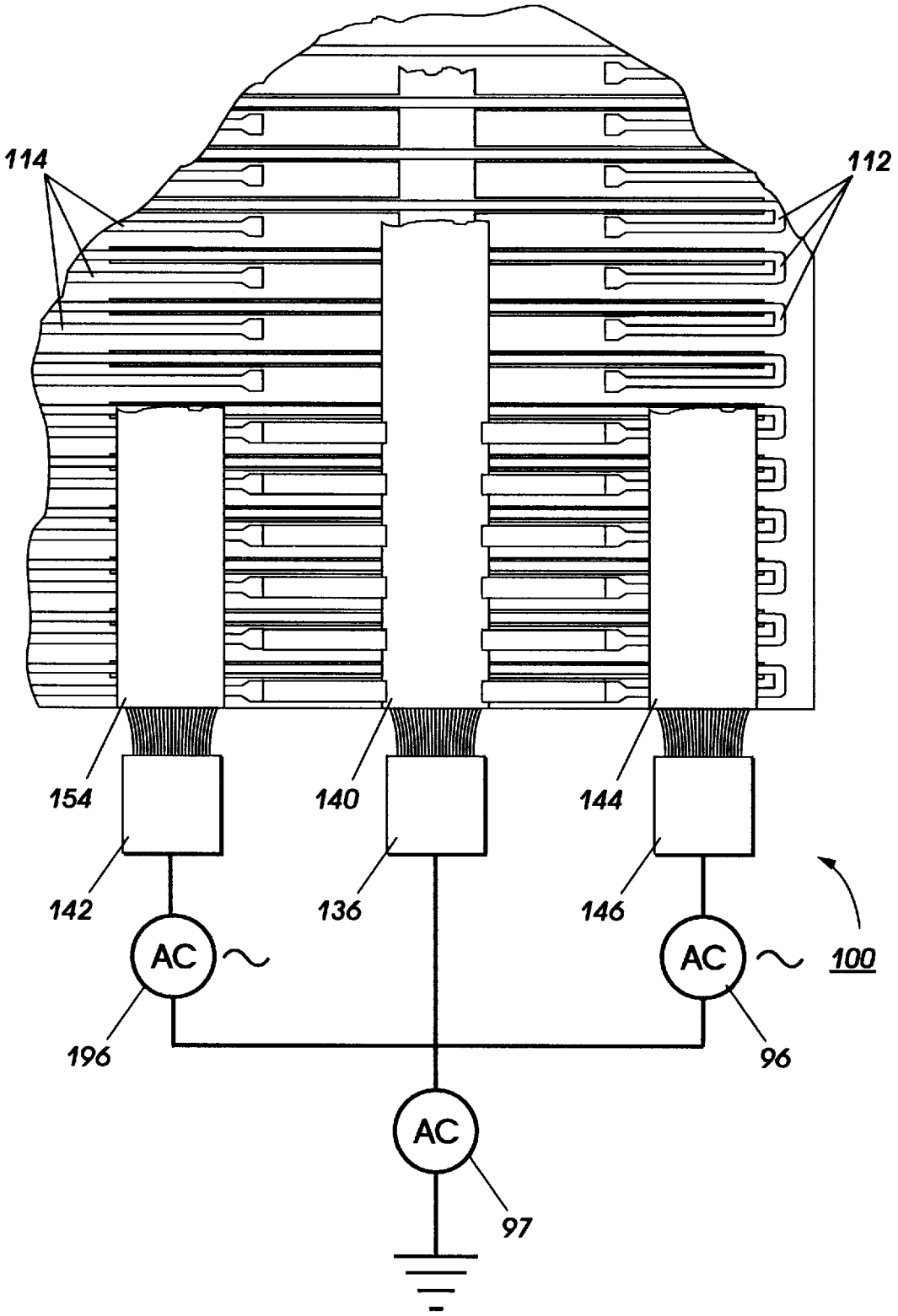
FIGS. 4 and 8 are a partial sectional view of the fabrication of the resistive network commutation segmented donor roll of FIG. 1.

For example, resistive members 134 and 135 may be in the form of individual rectangular resistors connecting the ends of each electrode to the central common ring as shown in FIG. 1 and FIG. 4, or can be formed by a continuous ribbon of electrically resistive material bridging the space between the ends of electrodes 112 or 114 and providing a current return path to the respective edges of common ring 140 on the surface of the donor roll 40. Alternatively, the conductive electrodes 112 and 114 and conductive common ring 140 may be formed after the various resistive layers are deposited on the surface of the donor roll so that the electrodes defining the boundaries of resistive members 134 are fully exposed.

The layers forming conductive common ring 140 and resistive rings 144 and 154 are preferably in the form of circumferential bands or ribbons having a width W1 approximately equal to or slightly larger than the width W2 of a first electrically contacting brush 136, in order to provide for easy mechanical alignment of the brush with respect to the band. For example, the width W1 may be in the range of approximately 1 to 5 mm. Brush 136 makes uninterrupted wiping contact with the surface of common ring 140 and is electrically driven by power source 97.

Resistive rings 144 and 154, and the deposits forming resistive elements 134 and 135 may, for example, be formulated from a polyamide based matrix in the form of a thick film resistive ink which is compatible with a body 102 made of Kapton®, a product of DuPont (UK) Ltd. A wide range of commercial resistive and conductive polymer thick film inks used in the fabrication of hybrid electronic circuits are readily available. Inks with low sheet resistivity in the range of a few milliOhms to a few hundred Ohms per square can be utilized to construct both sets of individual electrodes 112 and 114 in the form of narrow conductive traces, as well as common ring 140 used as a conductive slip ring, and a similar ink formulated to yield a resistivity of several megOhms per square can be used to deposit the resistive ribbon from which resistive rings 144 and 154 as well as resistive members 134 and 135 are formed. Alternatively, the network components may be made of more robust commercially available Ruthenium and noble metal-based cermet thick film hybrid microelectronic materials designed to be applied to ceramic substrates and fired at high temperature.

Electrically contacting brush 136 may be made of any suitable durable material, for example, pultruded carbon fiber filled material, a conductively impregnated plastic, solid and bifurcated graphite, a metal contact array, a strip of high conductivity polyamide resistor material on a Kapton® substrate in the form of a spring, a taught contacting ribbon of low resistance material that is tangent to the contact area, a conductive polyamide or other conductive elastomer in the form of a blade cleaner or doctor blade, a scrubbing contact or a snowplow contact which may provide improved surface cleaning of the electrical contact area. In each case the energizing currents are distributed to the active electrodes in the appropriate ratios by the rotating resistive network on the donor roll surface, whereas the brush functions only as an uninterrupted electrical contact with minimal internal resistance. This is an improvement on earlier designs where an extended brush with graded internal resistivity is required to provide a tailored energizing current profile.

Common ring 140 may be made of any suitable durable electrically conductive material such as a noble metal alloy, but is preferably fabricated using a hybrid electronic circuit thick film ink with sheet resistivity below about 100 Ohms per square. A second conductive brush 142 makes uninterrupted electrical contact with the surface of resistive ring 154 and provides an unbroken electrical path to power sources 196 and 97. The second brush 142 may be of any suitable electrically conductive material and may be identical to brush 136 in both material and design.

A second resistive ring 144 is positioned in close proximity to resistive members 135 circumferentially extending around the periphery of donor roll 40. A third conductive brush 146 makes uninterrupted electrical contact with the surface of resistive ring 144 and provides electrical continuity to power sources 96 and 97. All three brushes 136, 142, and 146 may be of any suitable electrically conductive material.

Figure 8:
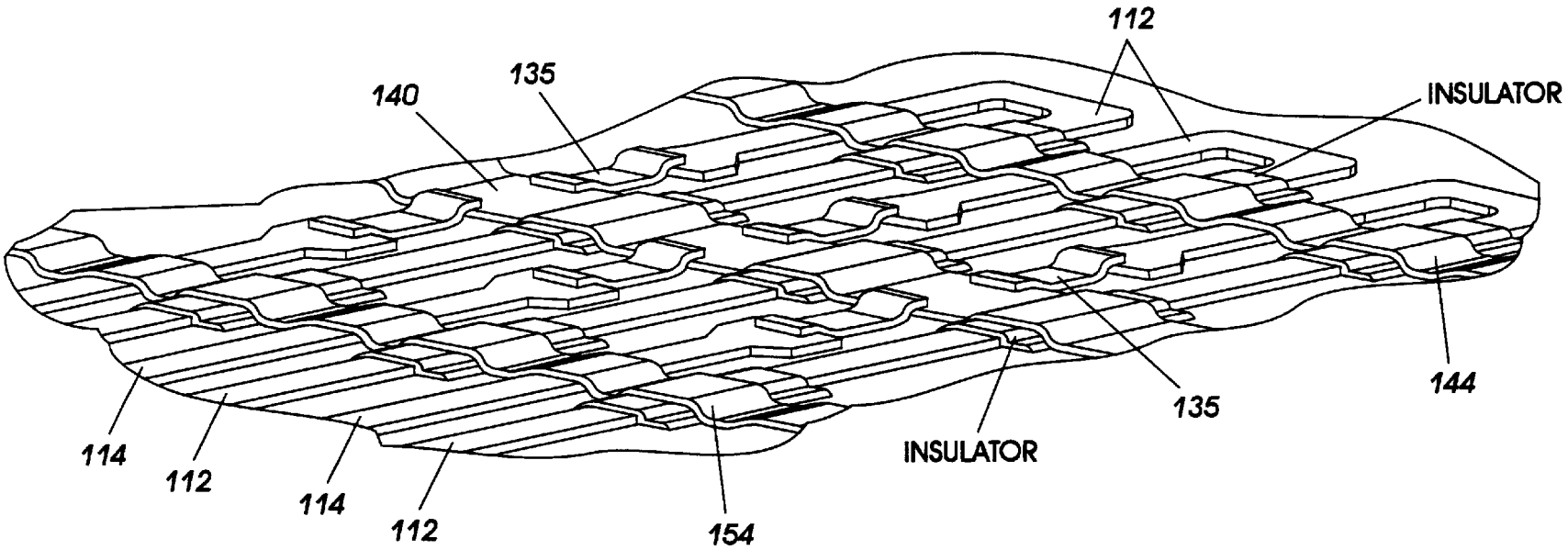

FIGS. 4 and 8 shows one of several equivalent layouts of the present invention fabricated with three rings at one end of the roll. The fabrication is most easily done in multiple steps. In FIG. 4, the electrodes and ring structure are shown in plain view, and the electrodes are understood to extend the full length of the roll to the left. Starting with the conductive electrode pattern (1), an insulating dielectric (2) is applied over part of the longer (even) electrode members 112 as shown. A central conductor (3) is applied over the central section of the insulator covering the even electrodes to form the "common" ring. Finally, two resistive ribbons are applied (4). One provides a continuous resistive path between adjacent odd electrodes without contacting any even elements, shown on the left in FIG. 4, the other provides a continuous resistive path between adjacent even electrodes without contacting any odd elements on the right in FIG. 4. In this step, the resistive elements 134 and 135 that provide each electrode with a return path directly to the central common ring 140 are also applied.

With this layout, the commutation brush assembly 100 provides two high voltage AC sources 180 degrees out of phase which are applied to the two resistive rings, and a connection to the common ring 140. A common connection is actually unnecessary for equal waveforms when the AC sources and loads are exactly balanced. However, the even and odd electrodes are likely to have slightly different parasitic capacity and hence represent different AC loads to their resistive networks. The direct connection to the common ring is therefore useful in balancing the AC excitation potentials delivered to the electrodes.

Figure 7:
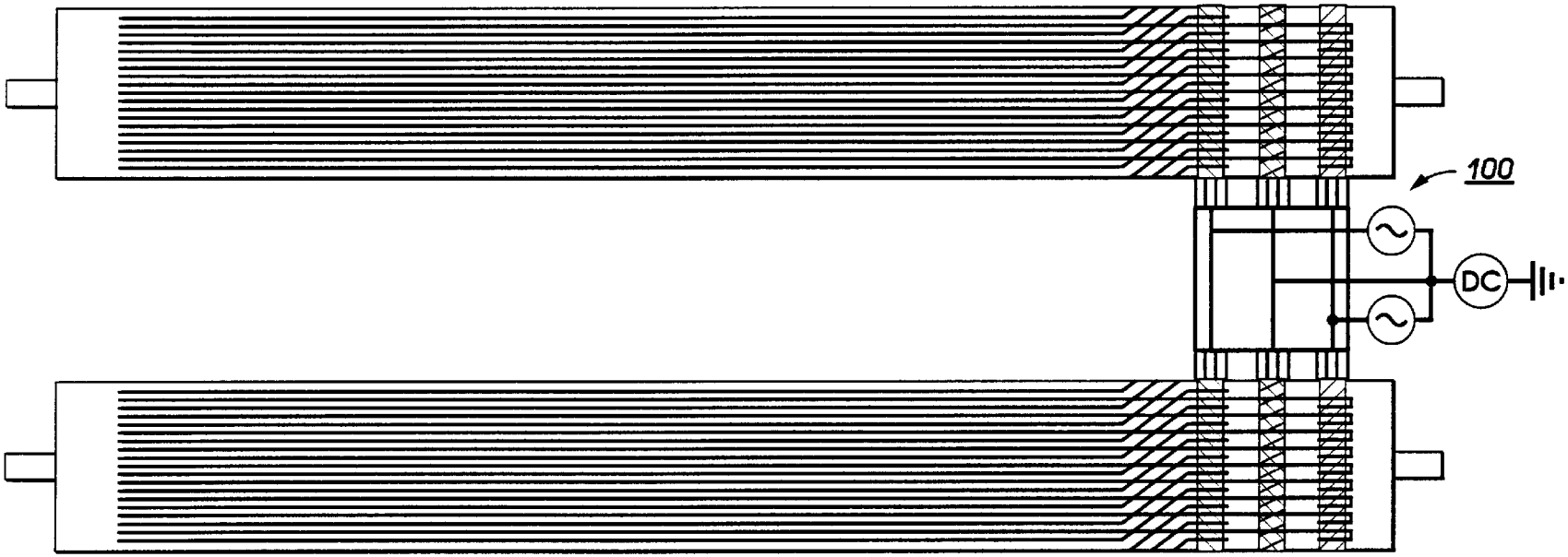
FIG. 7 is a plan view showing a compact brush assembly for supplying excitation potentials to an adjacent pair of resistive network commutation segmented donor rolls of FIG. 1.

To minimize the chances of unwanted electrical discharge through pinholes, it is preferred that the dielectric barrier layer (step 2) be fabricated by two or more separate applications of insulating material, a practice that is common in the manufacture of thin insulators. If desired, parasitic loading of the even and odd conductive lines can be equalized by adding capacitance to each of the odd (shorter) electrodes 114 in the array, for example, by extending and widening the extreme left-hand ends of these electrodes (not shown). FIG. 7 indicates how a single two-sided brush assembly can be designed to supply both AC excitation phases and a common connection to two adjacent rolls.

Figure 5:
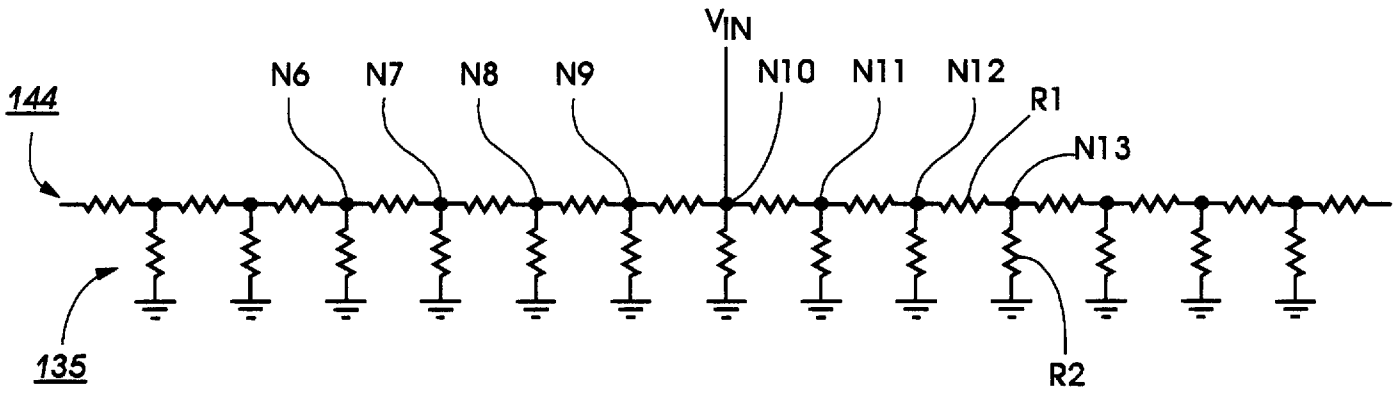
FIG. 5 is a simplified electrical circuit diagram of the resistive network commutation segmented donor roll of FIG. 1.

Referring now to FIG. 5, a simplified equivalent circuit of the network of each of the resistive rings 144 (or 154) and associated resistive elements 135 (or 134) is shown. Voltage $V_{IN}$ represents the nominal AC component of excitation voltage delivered from one of the two power sources 96 or 196 (see FIG. 1) and applied to the surface of one of the resistive ribbons 144 or 154 at the point of contact with the associated conductive brush 146 or 142 respectively. Resistors R1 drawn horizontally represent the current paths provided between electrodes by a resistive ring, and resistors R2 drawn vertically represent the associated resistive paths between these electrodes and the central common conductive ring 140. In FIG. 5, the DC component or bias voltage has been omitted and conductive ring 140 is shown as a distributed ground for clarity. It will be understood by those familiar with the art, that the nodes labeled N in FIG. 5 schematically represent successive even electrodes 112 when the chain of resistors R1 functionally describes resistive ring 144, and R2 stands for resistive elements 135 around the periphery of the roll, whereas nodes N also can represent successive even electrodes 114 when R1 is associated with resistive ring 154 and R2 stands for elements 134. It is believed that a description of FIG. 5 where N schematically represent successive even electrodes 112 is sufficient for purposes of the present application to illustrate the AC circuit behavior of both the even and odd electrode arrays which differ only in relative phase. Node N10 represents the even electrode 112 at the moment it makes proximal contact with brush 146 as the roll rotates, and is therefore at essentially the same voltage as delivered by the power source 96. Nodes N9 and N11 represent the even electrodes 112 on either side nearest the electrode in contact with the brush. Nodes N8 and N12 represent the even electrodes 112 next nearest the electrode in contact with brush 146.

Figure 6:
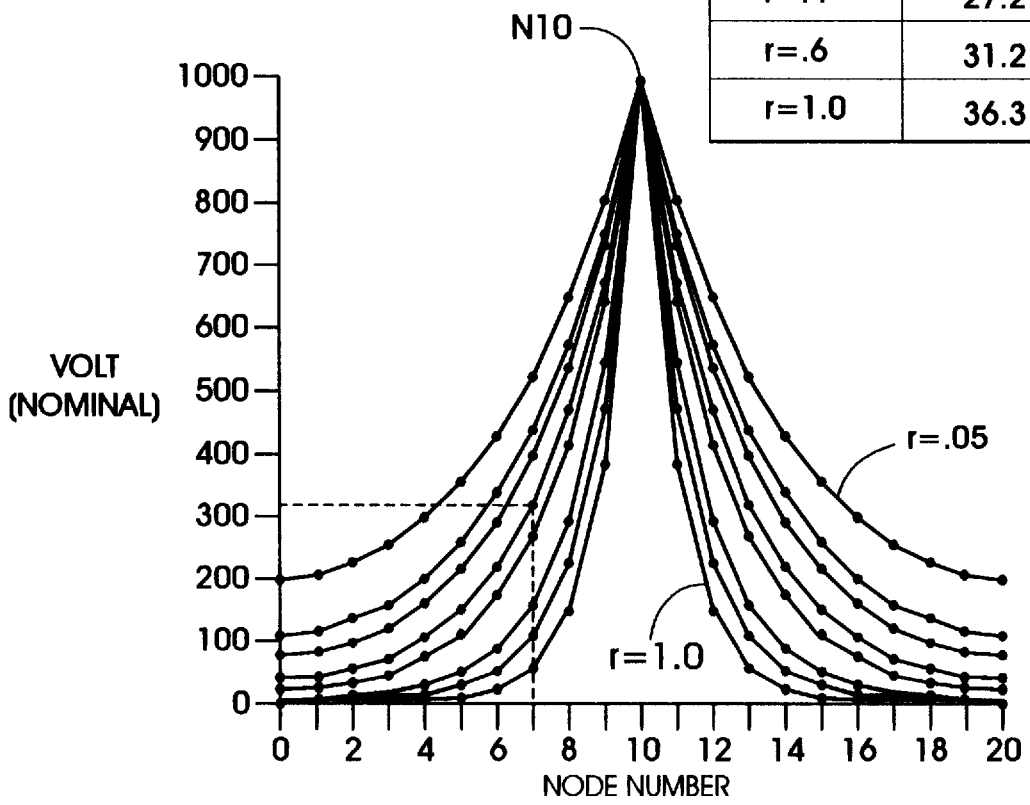
FIG. 6 is a graph of the voltages appearing on the electrodes of the resistive network commutation segmented donor roll of FIG. 1.

Referring now to the graph of FIG. 6, the distribution of node voltages indicating the AC voltage amplitudes distributed to the nodes in FIG. 5 is plotted versus the relative node position, with node $N_{10}$ representing the electrode in contact with the brush. Plots of the voltages at each node are shown for each of several resistance ratios, from r=0.05 to r=1.0. The plot is symmetric and assumes that only node $N_{10}$ is supplied power. It should be appreciated that it may be advantageous to have a plurality of adjacent nodes supplied with power in which case the distribution of potentials for the remaining nodes would be the same as shown in the plot. The resistance ratio r is defined as follows:

$$r=R_1/R_2$$

Where: $R_1$ is the resistance value of the ribbon segment of resistive ring 144 spanning between adjacent even electrodes 112.

R2 is the drain resistance providing a direct return current path to common ring 140 for each even electrode 112.

Different combinations of resistive ink materials may be selected for the two resistances $R_1$ and $R_2$, and the ratio r may be further tailored as needed by tailoring the geometry of the resistive segments of the resistive ring between neighboring electrode members 112, as well as the geometry of the resistive return path between each electrode and common ring 140. In addition to the enormous range of basic resistive ink formulations available i.e., from a few Ohms to many gigOhms per square, sheet resistivity can also be adjusted over a range of about 3:1 by varying the thickness of the deposition, and to a lesser degree, by adapting a non-standard curing cycle, i.e., overfiring or underfiring the deposited resistive materials at various peak temperatures and firing times. Lower values of the resistance ratio r result in more gradual changes in the applied voltage distribution profile as a result of the resistive network.

It can be seen from the plots in FIG. 6 for a resistance ratio r of 0.15, that a nominal input voltage $V_{IN}$ of 1,000 volts rms applied to node $N_{10}$ for powder cloud formation results in nodes $N_9$ and $N_{11}$ having an effective applied voltage of approximately 681 volts rms. Likewise nodes $N_8$ and $N_{12}$, have an effective applied voltage of 464 volts rms, nodes $N_7$ and $N_{13}$ are effectively driven at 316 volts rms, and nodes $N_6$ and $N_{14}$ are driven at 216 volts rms. Rather than having the abrupt voltage vs. time profile of prior art commutating systems, the AC excitation voltage applied to each electrode of the present invention gradually increases as the electrode moves into the development zone and drops off in a symmetrical way as the electrode moves out of the development zone, thus providing the required high voltage AC excitation in the development zone while limiting the voltage differential between adjacent electrodes outside the zone.

In recapulation, there has been provided a donor roll for transporting marking particles to an electrostatic latent image recorded on a surface is provided. The donor roll is adaptable for use with an electric field to assist in transporting the marking particles from the donor roll to a development zone adjacent the surface. The donor roll includes a rotatably mounted body and a first electrode member mounted on the body. The donor roll further includes a second electrode member mounted on the body and spaced from the first electrode member and a resistive member electrically interconnecting the first electrode member and the second electrode member so that when an activation potential for creating an electric field is applied to the first electrode member a portion of the potential will be transferred to the second electrode member creating an attenuated field.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. A donor roll for transporting marking particles to an electrostatic latent image recorded on a surface, said donor roll adaptable for use with an electric field to assist in transporting the marking particles from said donor roll to a development zone adjacent the surface, said donor roll comprising:

a mounted body;

a first electrode member mounted on said body;

a second electrode member mounted on said body and spaced from said first electrode member;

a first resistive member electrically interconnecting said first electrode member;

a second resistive member electrically interconnecting said second electrode member, said second resistive member overlays said first electrode member without being electrically interconnecting thereto; and wherein said first and second resistive member are mounted on a common end of said body.

2. A donor roll according to claim 1, wherein said resistive member comprises a layer of resistive material applied to a portion of said body.

3. A donor roll according to claim 1, wherein at least a portion of at least one of said first electrode member and said second electrode member is positioned between said body and said resistive member.

4. An apparatus for developing a latent image recorded on an imaging surface, comprising:

a donor roll for transporting marking particles to an electrostatic latent image recorded on a surface, said donor roll adaptable for use with an electric field to assist in transporting the marking particles from said donor roll to a development zone adjacent the surface, said donor roll including:

a mounted body;

a first electrode member mounted on said body;

a second electrode member mounted on said body and spaced from said first electrode member;

a first resistive member electrically interconnecting said first electrode member;

a second resistive member electrically interconnecting said second electrode member, said second resistive member overlays said first electrode member without being electrically interconnecting thereto; and wherein said first and second resistive member are mounted on a common end of said body.

* * * * *